United States Patent [19]

Janson

[11] 4,103,393

[45] Aug. 1, 1978

[54] CURTAIN SUSPENSION ASSEMBLY

[76] Inventor: Richard W. Janson, Box 8110, Canton, Ohio 44711

[21] Appl. No.: 734,984

[22] Filed: Oct. 22, 1976

Related U.S. Application Data

[62] Division of Ser. No. 617,508, Sep. 29, 1975, Pat. No. 4,014,071.

[51] Int. Cl.[2] ..... H47H 1/104

[52] U.S. Cl. ..... 16/94 R

[58] Field of Search ..... 16/87.4 R, 93 R, 93 D, 16/94 R, 94 D, 95 R, 95 D, 96 R, 96 D; 160/123, 126, 344, 345, 346, 347; 248/261, 262, 263, 265, 225.1; 211/123, 162; D8/377

[56] References Cited

U.S. PATENT DOCUMENTS

| | | | |
|---|---|---|---|
| 649,729 | 5/1900 | Isbills | 16/93 D |
| 1,605,258 | 11/1926 | Meiszner | 16/93 D |
| 2,525,048 | 10/1950 | Siff | 160/126 |
| 2,727,272 | 12/1955 | Hankin et al. | 16/93 D |
| 3,347,306 | 10/1967 | Potye | 16/96 D |
| 3,715,776 | 2/1973 | Tanaka | 16/96 D |

FOREIGN PATENT DOCUMENTS

| | | | |
|---|---|---|---|
| 1,154,245 | 9/1963 | Fed. Rep. of Germany | 16/94 D |
| 1,393,890 | 5/1975 | United Kingdom | 160/345 |

*Primary Examiner*—Mervin Stein

*Attorney, Agent, or Firm*—Mason, Mason and Albright

[57] ABSTRACT

A curtain rod assembly manufactured primarily from extruded aluminum components, the curtain rod defining an elongated cruciform groove in its upper portion to receive therein a like shaped support part, a horizontal flange being provided at the rod's lower portion to receive wheeled curtain carriers, the rod being symmetrical about a vertical plane. In a modification of the rod, instead of a vertically elongated cruciform groove, a vertical plate-liked portion is provided wherein such upper vertical portion is fastened through horizontal bolts to an overhead support, a flange on the lower aspect with a horizontal cross piece defining tracks for the wheeled curtain carriers as in the first modification, this second modification also being symmetrical about a vertical plane. A spacer support is provided for the first curtain rod having a pair of spaced parallel cruciform-shaped portions to be received in the like shaped slots of two overlapping parallel rods, the spacer including a stop member for carriers on one of the rods and a rope guide thereunder slideably to receive the curtain rope for supporting same. Live-end and deadend pulleys journalled in housings are provided which are adapted to support or be supported by a rod in a fixed relationship thereto so as to be aligned with the curtain carriers. The curtain rod is adapted to receive chain links in its cruciform slot for supporting the rod from the overhead structure at selected locations. The curtain rod also is adapted to be inverted whereby the flange, through a slot provided therein, is supported by overhead screw connections and a curtain carrier is received in the cruciform slot.

5 Claims, 22 Drawing Figures

FIG. 1
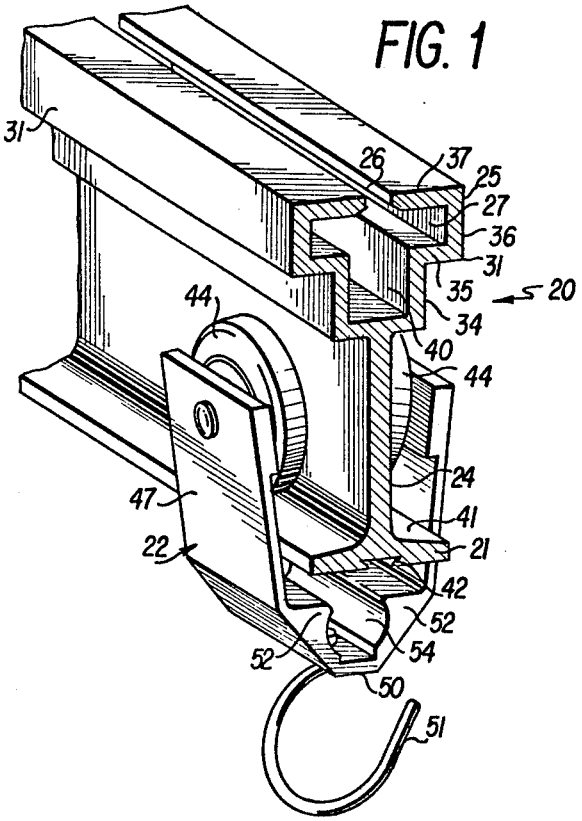
FIG. 1A
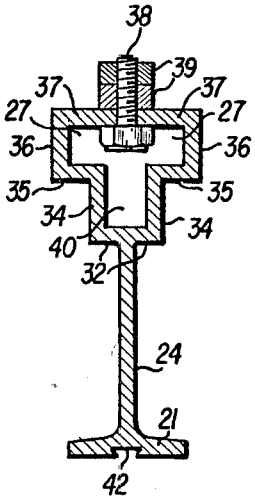
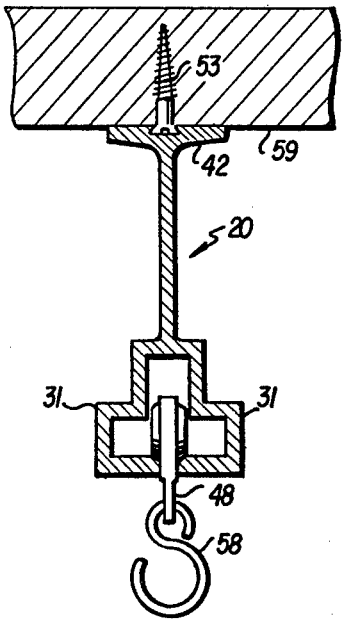
FIG. 1B
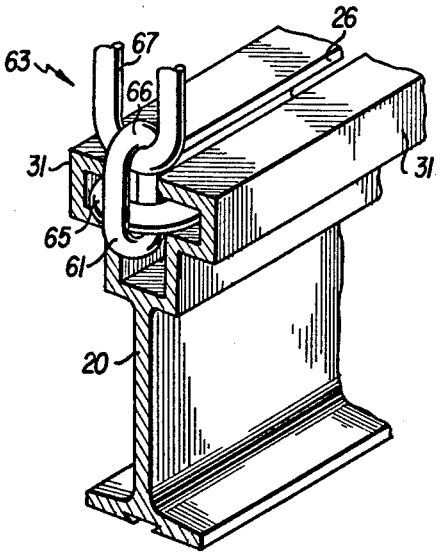
FIG. 2

CURTAIN SUSPENSION ASSEMBLY

RELATED APPLICATION

This is a division of application Ser. No. 617,508, filed Sept. 29, 1975, now U.S. Pat. No. 4,014,071 which issued Mar. 29, 1977.

BACKGROUND OF THE INVENTION

Many types and shapes of curtain suspension devices are available commercially and known in the prior art. These range from relatively modest devices such as found in homes and other living quarters to heavy duty suspension systems as found in theaters and those used in commercial establishments for large removable walls and doors. Examples of types of curtain suspension devices may be found in the patents to Hankin, U.S. Pat. Nos. 3,346,227 of Oct. 10, 1967, to Charron et al, U.S. Pat. No. 2,597,224, of May 20, 1972 and U.S. Des. No. 165,937 to Rosenbaum of Feb. 12, 1952. An increasing problem exists in the installation of curtain suspension assemblies — particularly the larger heavy-duty assemblages — in the labor costs of installing same. Thus as the curtain suspension systems become more complicated, time required for installation and the level of skill required increases. It has occurred to the inventor that this problem may be solved through designing the curtain suspension system at the plant as relatively simplified units which can be installed without the necessity of complicated or involved construction procedures and which at the same time are adaptable to a wide variety of architectural arrangements which may be encountered particularly in commercial and public establishments.

SUMMARY OF THE INVENTION

The invention relates to individual components of a curtain suspension assembly and to its components in various combinations. More particularly, the invention relates to such components, combinations and the assemblage thereof intended for heavy-duty use such as for the suspension of curtains in theaters and the like wherein the design and cooperation of the individual components facilitate its installation and the assemblage is thus easily installed and also adaptable to numerous overhead constructions which may be encountered.

Various components of the invention include a curtain rod which has flanges in its lower portion to receive curtain rod carriers and defines a cruciform-shaped groove of constant cross-section in its upper portion to receive a mating like shaped part of an overhead support or other component. The cruciform-shaped groove cooperates with an appropriately dimensioned link chain whereby the rod can be suspended from overhead structure without regard to the height of the structure and its location along the rod need not be specific to any feature of the curtain rod other than the longitudinal cruciform-shaped groove. Various supports which include the cruciform-shaped part for being received in the groove are adapted to cooperate with angle clips, gripping devices, bolts of various types and the like to provide considerable adaptability and flexibility in supporting and securing the curtain rod through the overhead structure at the installation site. Spacer dividers are included which automatically establish the amount of overlap at the mid portion of the curtain rods, provide a midway stop for the curtain rod carriers and further include a centrally located support for the rope which controls the curtains for opening and closing same. Live-end and deadend pulley housings with pulleys installed are further provided which may either be suspended from the cruciform-shaped groove of the curtain rod or from the lower flange thereof and secured so as not to be movable longitudinally relative to the curtain rod whereby they are automatically located in a desired position relative to the rest of the assemblage. A novel adaptability of the curtain rod in accordance with the invention is its capacity to be inverted and used as a curtain rod for lesser sized installations wherein carriers for the curtain are received within the cruciform-shaped groove with their curtain hooks depending therefrom. In a modification of the curtain rod for structures wherein the rod will be secured so as to lie transverse under and relative to a plurality of spaced overhead beams of the same height, the structure of the rod which defines the cruciform-shaped groove may be replaced by a vertical coplanar part which is fastened to the overhead by means of a plurality of angle clips.

From the foregoing, it should be understood by those skilled in the art that a primary object of the instant invention is the provision for a heavy duty adaptable and yet simplified curtain suspension system which is constituted of individual elements, such elements being preferably manufactured of extruded aluminum or other extruded material. However, other objects of adaptabilities and capabilities of the invention will be appreciated by those skilled in the art as the description progresses, reference being had to the accompanying drawings in which:

BRIEF DESCRIPTION OF THE DRAWINGS

FIG. 1 is a perspective view of a first embodiment of the invention showing the curtain rod and a curtain carrier thereon;

FIG. 1A illustrates the incorporation of limiting means in the curtain rod;

FIG. 1B shows the curtain rod in accordance with the invention in an inverted mode;

FIG. 2 is a perspective view of the curtain rod shown in FIG. 1 suspended by a link chain;

DESCRIPTION OF THE PREFERRED EMBODIMENTS

Figure 3:
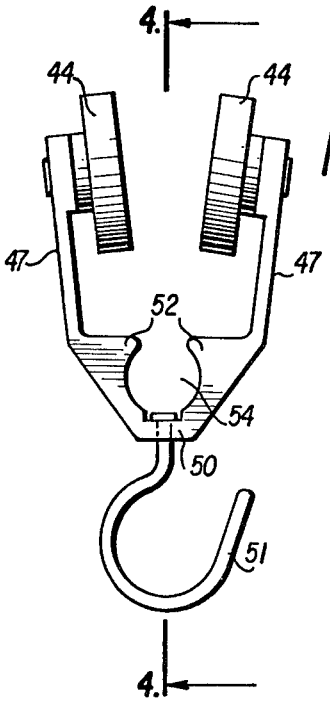
FIG. 3 is an elevational detail view of the carrier shown in FIG. 1.

The assembly of the invention which is intended for heavy duty use, comprises, as shown in FIG. 1, a curtain track or rod 20 which supports on its lower flange 21 a plurality of curtain carriers such as carrier 22. Rod 20 comprises a vertical part 24 which extends upwardly normally from flange 21 to the upper portion 25 which defines a slot 26 in groove 27 for receiving a rod support 30 as shown, for example, in FIG. 5. Upper portion 25 comprises a pair of arms 31 which, as seen in cross-section are mirror images, one of the other, each including first a horizontal extension 32, next a second vertical extension 34, then a third further horizontal extension 35, and next a fourth further vertical extension 36, each arm 31 then extending inwardly to define slot 26, thus terminating with a fifth still further horizontal extension 37. Arms 31 define a cruciform-shaped space as seen in cross-section which comprises upper slot 26, grooves 27 on either side and a lower recess 40 between vertical part 24 and slot 26. In the lower portion 41 of rod 20, flange 21 may be provided with a bottom groove 42 which is broader in its upper inner aspect than at its lower aspect.

Referring to FIG. 1A, a stop or limiting means is provided which comprises a bolt 38 which has its head within the grooves 27 and its threaded shank extends upwardly through slot 26 wherein it is threadably received by a pair of nuts 39.

As shown in FIG. 1B, by inverting rod 20, it may be utilized for a less expensive curtain track for a lighter curtain or drapes wherein the space defined by arms 31 receives a plurality of movable supporting members 48 which are each provided with a depending hanger portion 58, such supporting member 48 conforming to a structural device disclosed in U.S. Pat. No. 3,076,222 to P. H. Sloan of Feb. 5, 1973. The recess 42 is utilized to support rod 20 by a plurality of flat head screws 53 received and aligned in a ceiling member 59.

Figure 4:
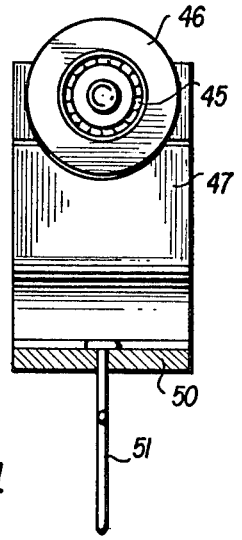
FIG. 4 is a sectional view of the carrier shown in FIG. 3 on section lines 3—3 of such Figure.
Figure 18:
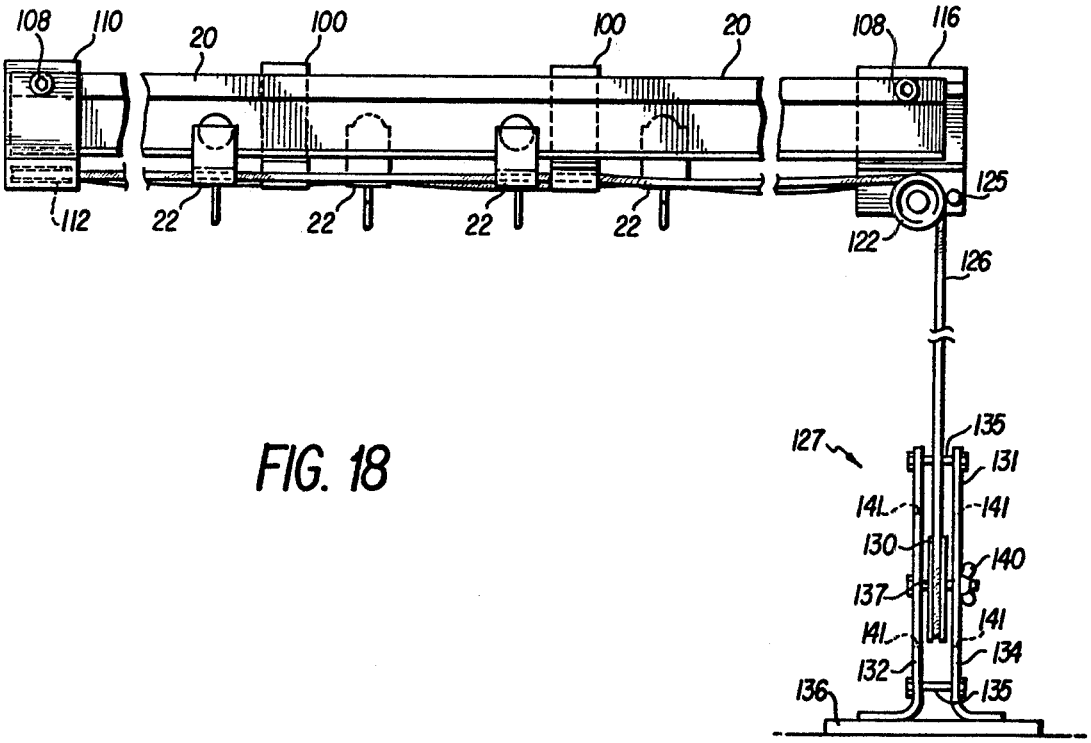
FIG. 18 is an elevational broken view which illustrates cooperation of various components of the curtain suspension assembly of the invention.

Curtain carriers 22 as shown in FIGS. 1, 3 and 4 incorporate two wheels 44, each such wheel having a race of ball bearings 45 and equipped with rubber or neoprene tires 46 for silent operation. Each wheel 44 is journalled to an arm member 47. The lower part of each arm member 47 joins and is integral with a horizontal member 50 which carries a depending curtain hook 51. Each arm member 47 also includes a thicker profiled part 52 which defines a horizontal cylindrical opening 54 for frictionally receiving the curtain rope 126 (FIG. 18).

Figure 5:
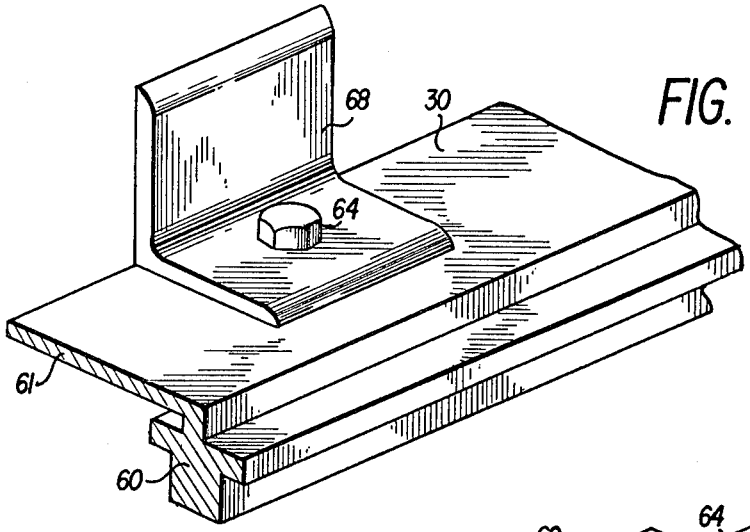
FIG. 5 is a perspective view of a rod support bolted to an angle clip.
Figure 6:
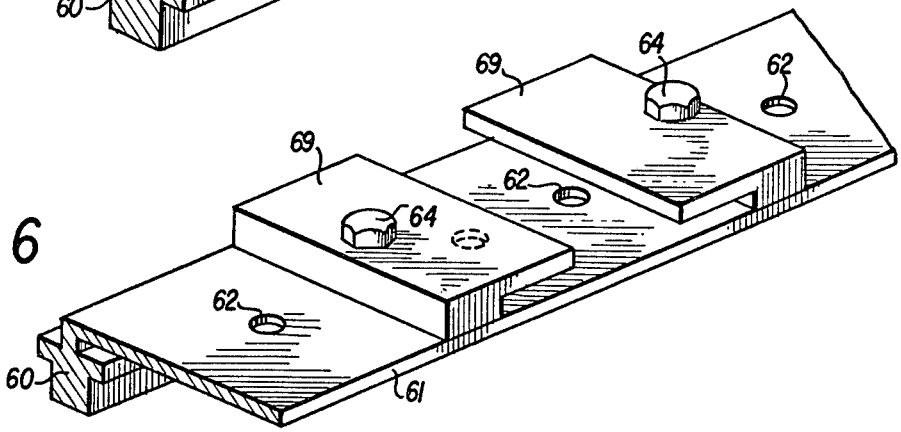
FIG. 6 is a perspective view of a rod support with cross-beam clamps bolted thereto.
Figure 8:
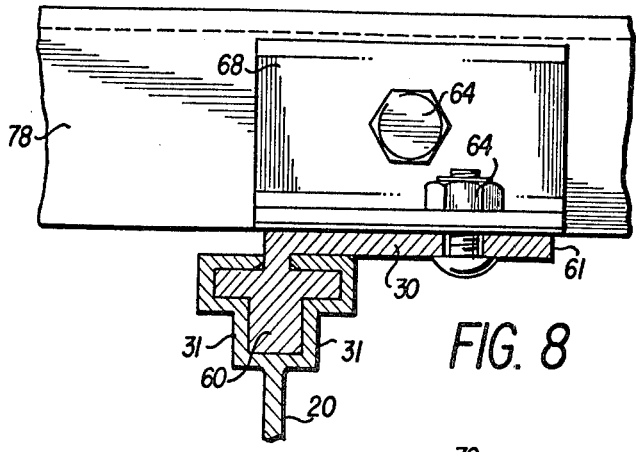
FIG. 8 is a broken view illustrating an angle clip similar to that shown in FIG. 5 together with the rod support and curtain rod.

Each rod support 30, as seen in FIGS. 5 and 8 includes a support part 60 of cruciform-shaped cross-section so as to mate with and be received slideably within the cruciform-shaped space defined by arms 31 of rod 20. Rod support 30 also comprises a horizontal flange member 61 extending in one direction from the top of part 60 and integral therewith. As illustrated in FIG. 6, flange member 61 may be provided with one or more openings 62 to receive bolts 64 or the like whereby support 30 may be connected to the lower flanges of I-beams of various sizes by cross-beam clamps 69 or via angle clip 68, to an overhead beam 78 as shown in FIG. 8.

Figure 7:
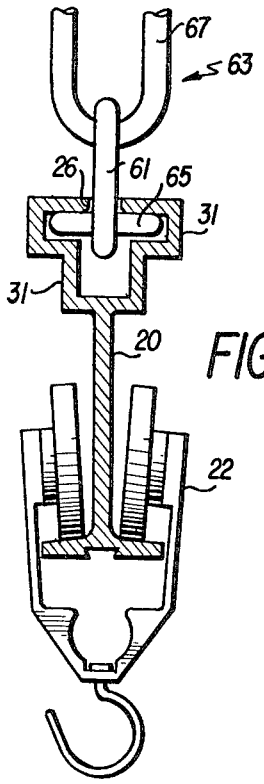
FIG. 7 is an elevational view showing a curtain rod supported by a link chain with a carrier.

With particular reference to FIGS. 2 and 7, a link chain 68 may be provided at any point along rod 20 and without the necessity of utilizing drills or other tools or bolts. This is accomplished by inserting the bottom or lower link 65 into the cruciform-shaped space defined by arms 31 with the next to last link 66 extending through the slot 26 in a vertical disposition. The next higher link 67 and other links also hang vertically. Accordingly, with an appropriate dimensioned link chain 63, rod 20 may be supported by such link chain without the necessity of drilling holes or using nuts and bolts. Moreover, the link chain 63 may be slipped along the slot 26 until under an overhead beam or other structured member to which chain 63 may be attached to support the curtain rod 20 at the desired height.

Figure 9:
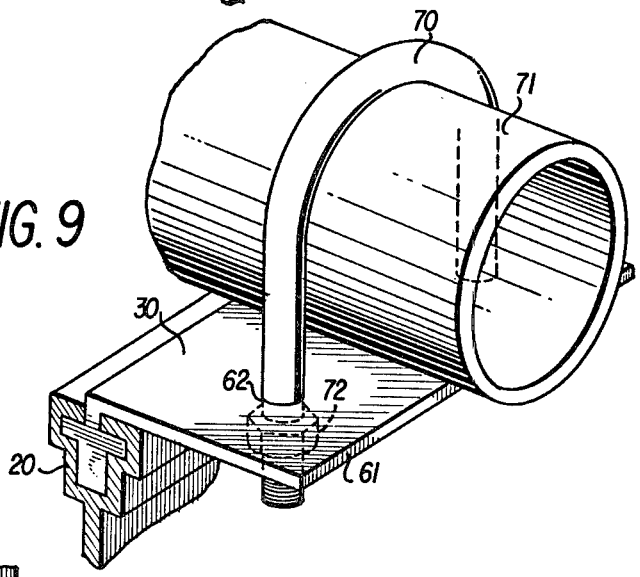
FIG. 9 is a perspective view illustrating a rod support as shown in FIG. 5 connected to an overhead pipe.

FIG. 9 illustrates a rod 20 supported by a rod support 30 which in turn has its flange member 61 connected to a pipe 71 by means of a U-bolt 70 received through a pair of openings 62 with lower threaded portions of U-bolt 70 receiving a pair of nuts 72 (only one shown). The extrusion which constitutes support 30 and flange member 61 may be severed at an angle other than 90° relative to rod 20.

Figure 10:
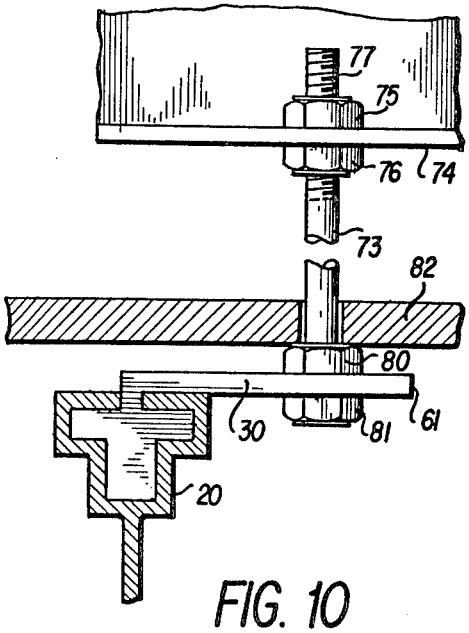
FIG. 10 is an elevational view illustrating means to suspend a rod support as shown in FIG. 5 under a suspended ceiling.

In FIG. 10, means for attaching the rod support 30 to a suspended ceiling 82 is disclosed. Here a bolt 73 is secured directly to an overhead bottom flange 74 of a steel roof member by nuts 75 and 76 received on the threaded end portion 77 of bolt 73. Flange member 61 receives the lower end of bolt 73 through an opening 62 and is secured theretor by means of nuts 80 and 81 in a manner whereby nut 80 performs the further function of contributing to the support of the suspended ceiling 82. Through this arrangement hangers or bolts 78 position rod support 30 immediately below the suspended ceiling 82.

Figure 11:
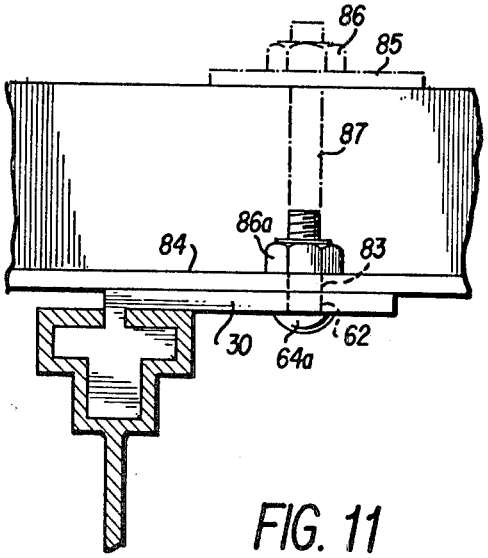
FIG. 11 is an elevational view illustrating connection of a rod support shown in FIG. 5 to the bottom chord of joists.

In FIG. 11, rod support 30 is fastened directly to the bottom of an exposed steel flange 84 or, if the bottom chord of the joist comprises angles situated back-to-back with a space between, longer bolts 87 as indicated in dot-dash lines are used with a heavy washer 85 to bridge such joists which are situated back-to-back, the heavy washer 85 held in place by means of a nut 86. In fastening rod support 30 directly to the bottom of steel flange 84, a short threaded bolt 64*a* is employed through the opening 62 and a further opening 83 in flange 84. A nut 86*a* is received by bolt 64*a* as shown in FIG. 11.

Figure 12:
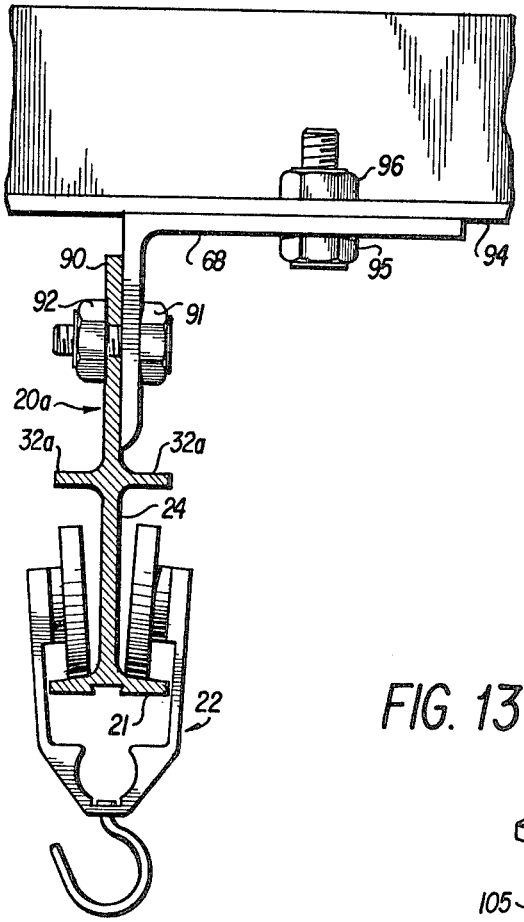
FIG. 12 is an elevational view of a modified curtain rod with a carrier thereon which is connected directly by means of an angle clip to the bottom chord of an overhead joist.
Figure 13:
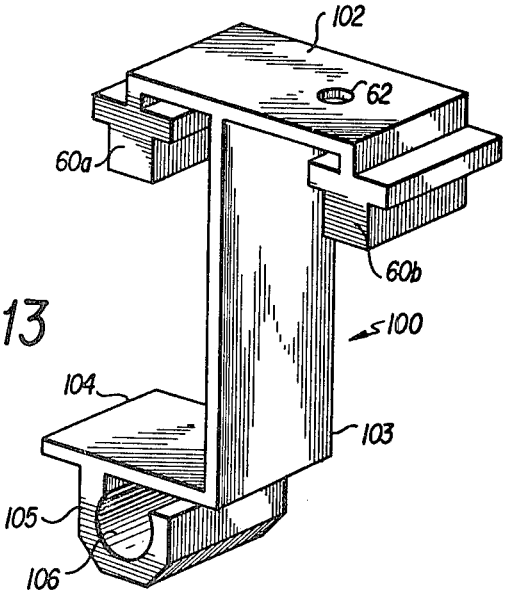
FIG. 13 is a perspective view of a combination lapping spacer, rod support, carrier bumper and rope holder.
Figure 14:
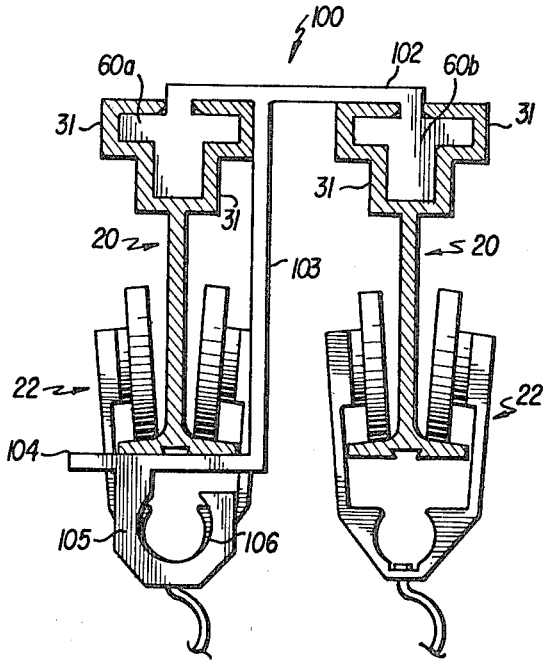
FIG. 14 is an elevational view of the spacer shown in FIG. 13 supporting a pair of curtain rods with a carrier shown on each.
Figure 15:
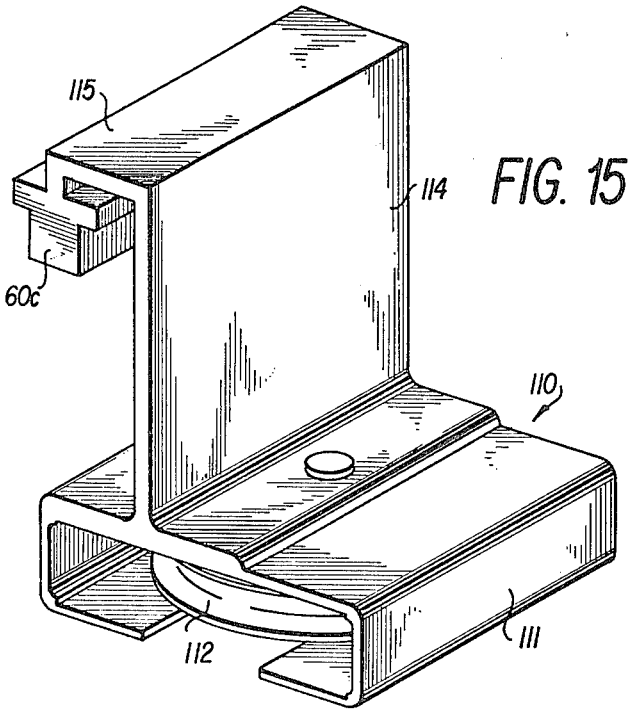
FIG. 15 is a perspective view of a combination deadend pulley and rod supports.
Figure 15A:
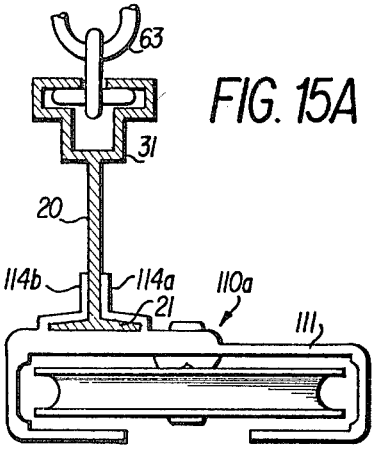
FIG. 15A is an elevational view of a rod supported deadend pulley.
Figure 16:
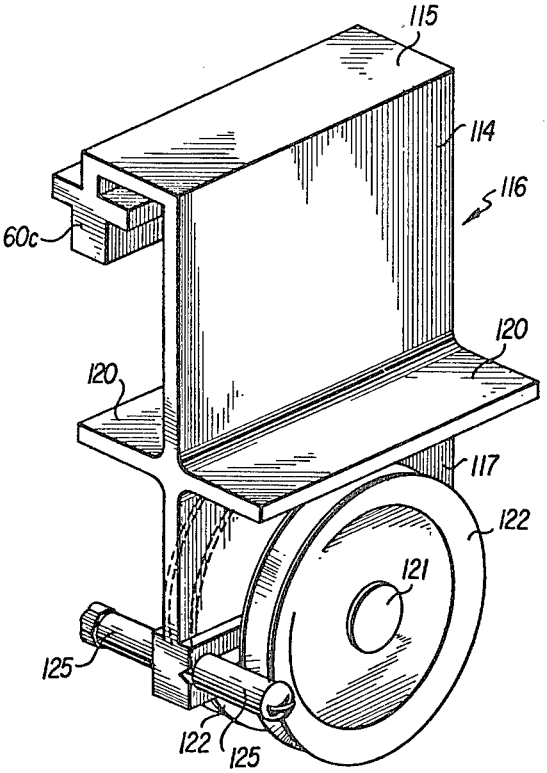
FIG. 16 is a perspective view of a combination live-endpulley and rod support.
Figure 16A:
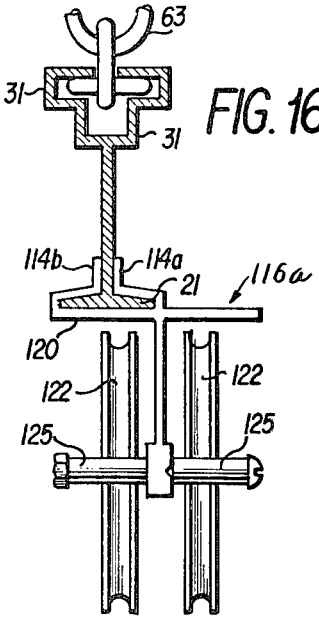
FIG. 16A is an elevational view of a rod supported live-end pulley.
Figure 17:
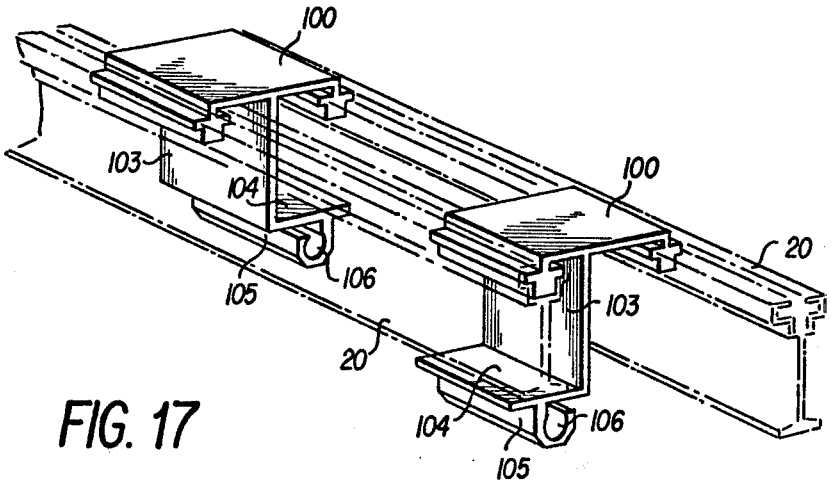
FIG. 17 is a perspective view illustrating the utilization of a pair of lapping spacers as shown in FIGS. 13 and 14 within the curtain suspension system.

In FIG. 12 a modified rod 20*a* is shown which is similar to rod 20 in that it includes a vertical part 24 and a lower flange 21 which supports curtain carriers 22. It also includes a pair of oppositely extending horizontal extensions 32*a*, but instead of having arms 31, a single